US011022386B2

(12) United States Patent
Muska

(10) Patent No.: US 11,022,386 B2
(45) Date of Patent: Jun. 1, 2021

(54) FIREARM BREECH COVER INTERLOCK

(71) Applicant: Smith & Wesson Inc., Springfield, MA (US)

(72) Inventor: Simon M. Muska, Enfield, CT (US)

(73) Assignee: Smith & Wesson Inc., Springfield, MA (US)

( * ) Notice: Subject to any disclaimer, the term of this patent is extended or adjusted under 35 U.S.C. 154(b) by 0 days.

(21) Appl. No.: 16/993,640

(22) Filed: Aug. 14, 2020

(65) Prior Publication Data

US 2021/0048261 A1 Feb. 18, 2021

Related U.S. Application Data

(60) Provisional application No. 62/886,997, filed on Aug. 15, 2019.

(51) Int. Cl.

| | |
|---|---|
| ***F41C 7/02*** | (2006.01) |
| ***F41A 3/58*** | (2006.01) |
| ***F41A 3/66*** | (2006.01) |
| ***F41A 3/72*** | (2006.01) |

(52) U.S. Cl.
CPC ..... *F41A 3/58* (2013.01); *F41A 3/66* (2013.01); *F41A 3/72* (2013.01); *F41C 7/02* (2013.01)

(58) Field of Classification Search
CPC ..... F41C 7/02; F41C 7/04
See application file for complete search history.

(56) References Cited

U.S. PATENT DOCUMENTS

| | | | |
|---|---|---|---|
| 1,344,991 | A | 6/1920 | Cunningham |
| 1,386,247 | A | 8/1921 | Fordyce |
| 1,637,400 | A | 8/1927 | Von Kiraly et al. |
| 1,709,399 | A | 4/1929 | Herlach et al. |
| 1,801,072 | A | 4/1931 | Browning |
| 1,801,073 | A | 4/1931 | Browning |
| 1,803,352 | A | 5/1931 | Tansley |
| 1,818,984 | A | 8/1931 | Browning |
| 1,878,038 | A | 9/1932 | Frommer |
| 1,892,259 | A | 12/1932 | Frommer |
| 1,907,164 | A | 5/1933 | White |
| 1,911,494 | A | 5/1933 | Floyd |

(Continued)

FOREIGN PATENT DOCUMENTS

| | | |
|---|---|---|
| CH | 175058 | 2/1935 |
| DE | 202004016026 | 1/2005 |

(Continued)

*Primary Examiner* — Reginald S Tillman, Jr.
(74) *Attorney, Agent, or Firm* — John A. Chionchio, Esq.; Ballard Spahr LLP

(57) ABSTRACT

A breech cover interlock coordinates the motion of a breech cover with the motion of the fore end of a pump action firearm. The interlock features an action bar which is connected to the fore end and has a catch which is engaged by a latch mounted with the cover on a movable buttstock. Engagement between the catch and the latch prevents the buttstock and cover from moving and thereby exposing the firearm's breech while the firearm's action is in battery as evidenced by the position of the fore end. Motion of the fore end out of battery disengages the latch and catch and permits the cover to be moved out of overlying position with the breech to permit access to the breech to clear a malfunction.

19 Claims, 7 Drawing Sheets

(56) References Cited

U.S. PATENT DOCUMENTS 2,016,646 A 10/1935 Mancini
2,047,789 A 7/1936 Loomis
2,103,512 A * 12/1937 Burton ..... F41A 3/32 42/20
2,196,852 A 4/1940 Browning
2,391,756 A 12/1945 Vesely
2,562,037 A 7/1951 Humeston
2,637,247 A 5/1953 Hester
2,970,398 A 2/1961 Crouch
3,020,662 A 2/1962 Merkel
3,075,511 A 1/1963 Ryan
3,077,044 A 2/1963 Reed
3,101,703 A 8/1963 Ryan
3,233,546 A 2/1966 Foote et al.
3,399,481 A 9/1968 Giorgini
3,512,290 A 5/1970 Violette, Jr. et al.
3,570,366 A 3/1971 Nickel
3,611,869 A 10/1971 Hupp
3,630,118 A 12/1971 Stoner
3,731,588 A 5/1973 Curtis et al.
3,744,371 A 7/1973 McFarland
3,766,825 A 10/1973 Robinson
3,768,190 A 10/1973 Ruger et al.
3,810,326 A 5/1974 Hilberg et al.
3,999,461 A 12/1976 Johnson et al.
4,004,489 A 1/1977 Johnson et al.
4,022,105 A 5/1977 White
4,061,074 A 12/1977 Johnson et al.
4,069,740 A 1/1978 Hottinger et al.
4,119,012 A 10/1978 Frye
4,223,589 A 9/1980 Post
4,395,937 A 8/1983 Ottolini
4,463,654 A 8/1984 Barnes et al.
4,562,659 A 1/1986 Neta
4,601,123 A 7/1986 Swearengen et al.
4,635,530 A 1/1987 Weldle
4,663,876 A 5/1987 Reaume
4,677,781 A 7/1987 Lee
4,709,617 A 12/1987 Anderson
4,856,410 A 8/1989 Anderson
4,867,039 A 9/1989 Dobbins
4,869,008 A 9/1989 Rasmussen
4,882,973 A 11/1989 Piscetta
4,932,148 A 6/1990 Barrett
4,944,109 A 7/1990 Zedrosser
5,119,575 A 6/1992 Gajdica
5,171,934 A 12/1992 Moore
5,235,769 A 8/1993 Stead et al.
5,361,700 A 11/1994 Carbone
5,367,810 A 11/1994 Stead et al.
5,675,110 A 12/1997 Gyre et al.
5,827,991 A 10/1998 Predazzer
5,834,678 A 11/1998 Kalb
6,135,005 A 10/2000 Dobbins
6,415,701 B1 11/2002 Dobbins
6,481,144 B1 11/2002 Chee et al.
6,779,461 B1 8/2004 Olson et al.
6,860,207 B1 3/2005 Robertson
6,877,265 B2 4/2005 Hajjar et al.
7,047,684 B2 5/2006 Roh
7,066,092 B2 6/2006 Olson et al.
7,069,863 B2 7/2006 Olson et al.
7,165,352 B2 1/2007 Langlotz
7,231,864 B2 6/2007 Ratti
7,252,038 B2 8/2007 Olson et al.
7,356,958 B2 4/2008 Weir
7,380,361 B2 6/2008 Hajjar et al.
7,448,307 B1 11/2008 Dafinov
7,451,706 B2 11/2008 Meyer
7,469,496 B1 12/2008 Kellgren
7,493,718 B2 2/2009 Gorzen
7,526,887 B2 * 5/2009 Engel ..... F41C 7/02 42/10
7,634,959 B2 12/2009 Frickey
7,814,695 B1 10/2010 Keeney et al.
7,921,779 B1 4/2011 Olson et al.
7,966,762 B2 6/2011 Barrett
8,122,635 B2 2/2012 Pullicar
8,161,886 B2 4/2012 Meyer
8,261,479 B2 9/2012 Barrett
8,353,123 B2 1/2013 Pullicar et al.
8,615,915 B2 12/2013 Hunter et al.
8,683,725 B2 4/2014 Munson
8,683,726 B1 4/2014 Genton
8,733,007 B2 5/2014 Hatfield
8,782,940 B1 7/2014 Morris
8,806,788 B1 8/2014 Hu
8,819,976 B1 9/2014 Kellgren
8,826,577 B1 9/2014 Bentley
8,839,709 B1 9/2014 Crye et al.
8,869,672 B2 10/2014 Smith
8,925,234 B1 1/2015 Barrett
8,931,393 B1 1/2015 Vincent et al.
8,944,041 B2 2/2015 Hu
9,010,233 B2 4/2015 St. George
9,015,979 B2 4/2015 Safewright, Jr.
9,015,981 B2 4/2015 Zamlinsky
9,021,935 B1 5/2015 Kellgren
9,062,922 B1 6/2015 Burt et al.
9,097,476 B2 8/2015 Mead et al.
9,109,849 B2 8/2015 Young et al.
9,109,856 B1 8/2015 Zamlinsky
9,115,954 B1 8/2015 Corsi et al.
9,188,399 B1 11/2015 Findlay et al.
9,200,857 B1 12/2015 Kellgren
9,341,429 B1 1/2016 Reavis, III
9,347,725 B2 5/2016 McAlister
9,347,737 B2 5/2016 Troy et al.
9,534,861 B1 1/2017 Kellgren
9,562,731 B2 2/2017 Geissele
9,612,067 B2 4/2017 Boyarkin
9,759,504 B2 9/2017 Geissele
9,958,230 B1 5/2018 Nugent et al.
10,006,727 B2 6/2018 Barrett et al.
10,041,754 B2 8/2018 Tamir
10,088,257 B2 10/2018 Popikov et al.
10,145,631 B2 12/2018 Barrett et al.
10,161,709 B1 12/2018 Wright
10,288,369 B2 5/2019 Albury
10,317,156 B2 6/2019 Shaver
10,345,074 B1 7/2019 Zamlinskiy
10,605,548 B1 3/2020 Lukofnak, III
2005/0235546 A1 10/2005 Wonisch et al.
2007/0033850 A1 2/2007 Murello et al.
2007/0151438 A1 7/2007 Courty
2008/0121096 A1 5/2008 Hajjar et al.
2009/0211140 A1 8/2009 Rolfe
2011/0209607 A1 9/2011 St. George
2013/0185975 A1 7/2013 Johnson
2014/0075803 A1 3/2014 Muller
2014/0075812 A1 3/2014 Johnson
2015/0089854 A1 * 4/2015 Findlay ..... F41A 19/47 42/20
2015/0107143 A1 4/2015 Coetzee et al.
2015/0316339 A1 11/2015 Young et al.
2016/0153732 A1 6/2016 Geissele
2018/0224233 A1 8/2018 Macy
2019/0186854 A1 6/2019 Berrett et al.
2019/0204034 A1 7/2019 Young et al.

FOREIGN PATENT DOCUMENTS

DE 102007034671 1/2009
DE 102007034675 1/2009
FR 2231936 12/1974
FR 2502321 9/1982
GB 573429 6/1941
RU 2055296 2/1996
WO 200114819 3/2001
WO 2005015113 2/2005
WO 2012005829 1/2012

* cited by examiner

FIREARM BREECH COVER INTERLOCK

CROSS REFERENCE TO RELATED APPLICATIONS

This application is based upon and claims benefit of priority to U.S. Provisional Application No. 62/886,997, filed Aug. 15, 2019, which application is hereby incorporated by reference herein.

FIELD OF THE INVENTION

This invention relates to interlock mechanisms to prevent discharge of firearms.

BACKGROUND

Reciprocable covers overlying the breech of a breach loaded weapon are useful to allow ammunition feeding malfunctions to be cleared by providing access to the breech and parts of the weapon's action by simply moving the cover to expose the breech and action. When using a reciprocable cover overlying the action of a breech loading firearm such as a shotgun, it is prudent to provide a means preventing firing of the shotgun when the cover is in an open position exposing the action. When the fire control group of the firearm is remote from the cover, as is the case for a "bullpup" configuration, fire control disconnection is impractical. For a firearm such as a bullpup shotgun, it would be advantageous to provide a mechanical interlock which prevents the action from returning to battery (thus preventing discharge of the shotgun) while the cover remains in an open position.

SUMMARY

The invention concerns an interlock for coordinating motion of a breech cover assembly relatively to a breech of a firearm with a position of a fore end of the firearm. The breech cover assembly is movable between a first position overlying the breech and a second position not overlying the breech. The fore end is movable between a first position placing the firearm in battery and a second position placing the firearm out of battery. In an example embodiment the interlock comprises a latch mountable on the breech cover assembly. The latch is movable with the assembly relatively to the breech. An action bar has first and second ends oppositely disposed. The action bar defines a longitudinal axis between the ends. The action bar is movably mountable on the firearm. The first end of the action bar is attachable to the fore end and the second end comprises a catch. The catch is engageable with the latch when the fore end and the breech cover assembly are each in the first positions respectively. Engagement between the catch and the latch prevents motion of the breech cover assembly into the second position while the firearm is in battery. Motion of the fore end into the second position disengages the catch and the latch from one another thereby permitting motion of the breech cover assembly into the second position not overlying the breech when the firearm is out of battery.

By way of example, the latch is pivotably mountable on the breech cover assembly. In a specific example the latch may further comprise a spring biasing the latch into engagement with the catch. In an example embodiment the latch comprises a first hook and the action bar comprises a second hook positioned proximate to the second end of the action bar. The first hook is engageable with the second hook.

Further by way of example the first hook comprises a first engagement surface oriented angularly with respect to the longitudinal axis and the second hook comprises a second engagement surface oriented angularly with respect to the longitudinal axis. The first engagement surface contacts the second engagement surface when the hook engages the catch. The first engagement surface has a first orientation angle and the second engagement surface has a second orientation angle. In an example embodiment the first and second orientation angles are complementary to one another.

By way of further example the action bar may comprise a ramp surface positioned proximate to the catch. The ramp surface engages the latch upon relative motion between the action bar and the latch.

The invention also encompasses a firearm. In an example embodiment the firearm comprises a receiver. A barrel is mounted on the receiver. The barrel has a breech. An action is positioned within the receiver. A fore end is mounted on the receiver and is movable between a first position placing the action in battery and a second position placing the action out of battery. A breech cover assembly is mounted on the receiver. The breech cover assembly is movable between a first position overlying the breech and a second position not overlying the breech.

An interlock coordinates motion of the breech cover assembly relatively to the breech with a position of the fore end. In an example embodiment the interlock comprises a latch mounted on the breech cover assembly and movable therewith relatively to the breech. An action bar has first and second ends oppositely disposed. The action bar defines a longitudinal axis between its ends. The action bar is movably mounted on the firearm. The first end of the action bar is attached to the fore end and the second end comprises a catch. The catch is engageable with the latch when the fore end and the breech cover assembly are each in the first positions respectively. Engagement between the catch and the latch prevents motion of the breech cover assembly into the second position while the firearm is in battery. Motion of the fore end into the second position disengages the catch and the latch from one another thereby permitting motion of the breech cover assembly into the second position not overlying the breech when the firearm is out of battery.

In an example embodiment the latch is pivotably mounted on the breech cover assembly. Further by way of example, a spring bias the latch into engagement with the catch. In an example embodiment the latch comprises a first hook and the action bar comprises a second hook positioned proximate to the second end of the action bar. The first hook is engageable with the second hook. By way of further example the first hook comprises a first engagement surface oriented angularly with respect to the longitudinal axis and the second hook comprises a second engagement surface oriented angularly with respect to the longitudinal axis. The first engagement surface contacts the second engagement surface when the hook engages the catch.

By way of example the first engagement surface has a first orientation angle and the second engagement surface has a second orientation angle. The first and second orientation angles may be complementary to one another in an example embodiment. Further by way of example the action bar may further comprise a ramp surface positioned proximate to the catch. The ramp surface engages the latch upon relative motion between the action bar and the latch.

In an example embodiment the breech cover assembly comprises a buttstock mounted on the receiver. The buttstock is movable toward and away from the breech. The latch is mounted on the buttstock. A cover is also mounted on the buttstock. In an example embodiment the latch is pivotably mounted on the buttstock. In a further example a spring acts between the buttstock and the latch for biasing the latch into engagement with the catch.

An example firearm according to the invention may comprise a shotgun. Further by way of example, the shotgun may have a bullpup configuration.

BRIEF DESCRIPTION OF THE DRAWINGS

FIG. 2A is a partial sectional side view of a portion of the firearm shown in FIG. 2 on an enlarged scale;

FIG. 3A is a partial sectional side view of a portion of the firearm shown in FIG. 2 on an enlarged scale;

FIG. 4A is a partial sectional side view of a portion of the firearm shown in FIG. 4;

FIG. 5A is a partial sectional side view of a portion of the firearm shown in FIG. 5 on an enlarged scale;

FIGS. 6A, 6B and 6C are sectional side views of a portion of the firearm shown in FIG. 6 on an enlarged scale.

DETAILED DESCRIPTION

Figure 1:
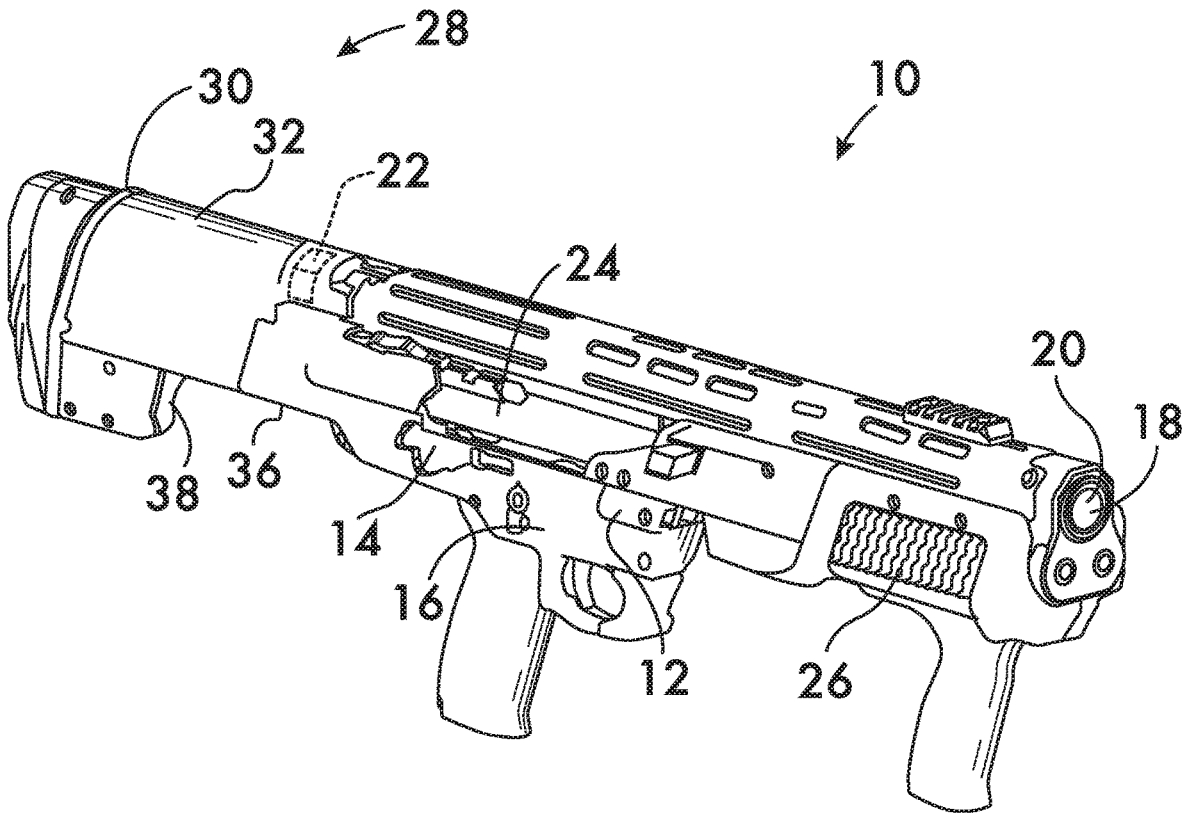
FIG. 1 is an isometric view of an example firearm having an example breech cover interlock according to the invention.

FIG. 1 shows an example embodiment of a firearm according to the invention, in this example a shotgun 10. Shotgun 10 comprises a receiver 12 which houses the firearm's action 14. As is well understood, action 14 includes the various mechanisms such as the bolt, ammunition feed cut-offs, and the ammunition elevator (not shown) which receive a round of ammunition from a magazine, chamber the round in a barrel, lock the bolt with the barrel breech, fire the round, extract and eject the spent cartridge during the firing cycle of such breech loading weapons. Receiver 12 also houses the fire control group 16 which comprises components such as the sear, trigger, hammer, and firing pin (not shown) which cooperate with the action 14 to fire the round. Shotgun 10 has a "bullpup" configuration in which the action 14 is located behind the fire control group 16. A barrel 18 is mounted on the receiver 12. Barrel 18 has a muzzle end 20 and a breech 22. Two tubular ammunition magazines 24 (right magazine shown) are mounted below the barrel 18 side by side. A fore end 26 is mounted on receiver 12 beneath the magazines 24 and the barrel 18. The fore end 26 engages the action 14 and is manually movable between a first position (shown) which places the action 14 "in battery" (bolt locked with the breech, ready to fire) and a second position "out of battery" (bolt unlocked, breech open, see FIG. 3) to work the action 14 during operation of the firearm as is well understood for pump action shotguns. A breech cover assembly 28 is also mounted on the receiver 12. In this example embodiment the breech cover assembly 28 comprises a butt stock 30 on which a cover 32 is mounted. Breech cover assembly 28 is movable between a first position in which the cover 32 overlies the breech 22 (shown) and a second position wherein the cover does not overlie the breech (see FIG. 4).

Figure 2:
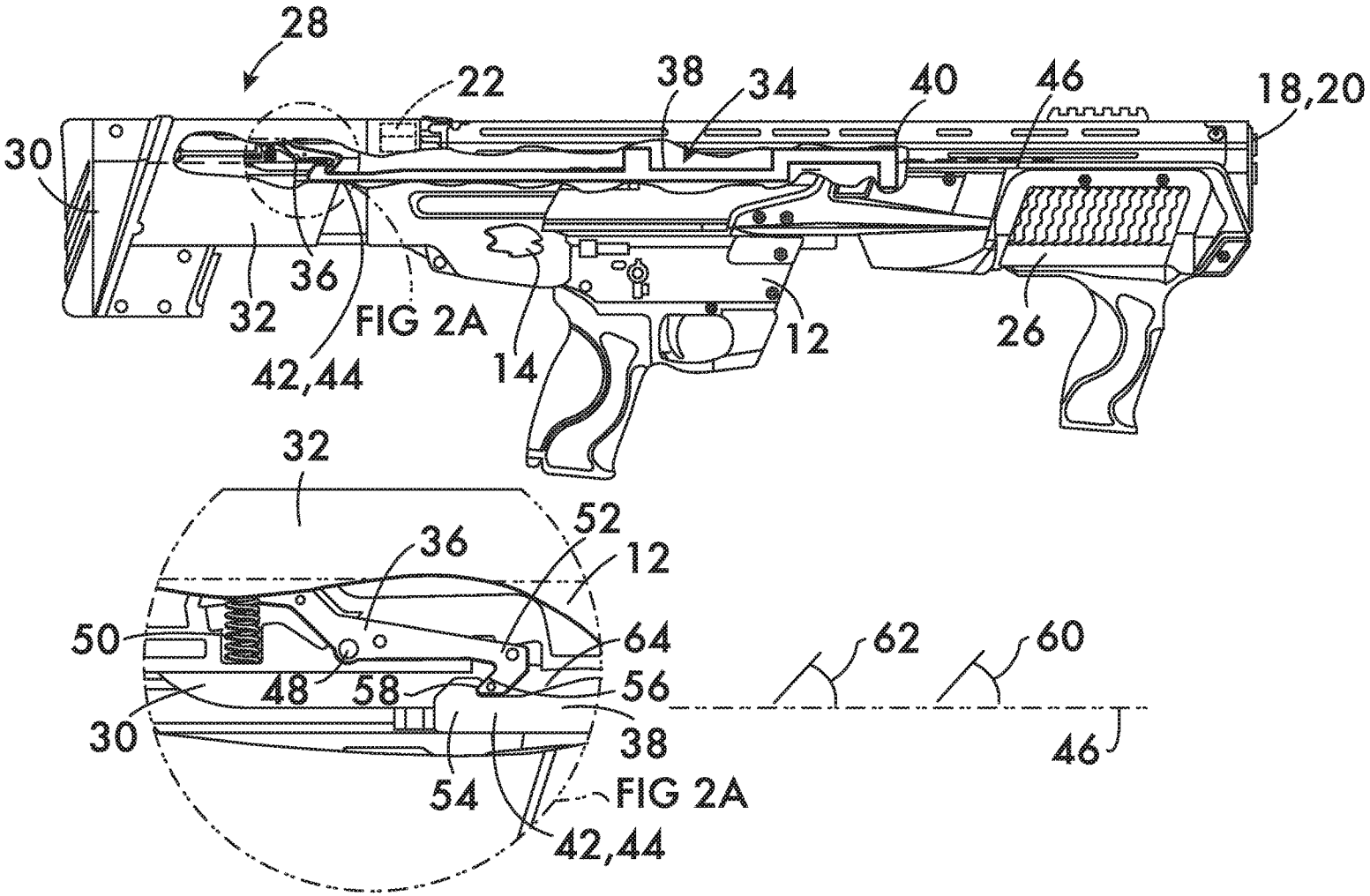
FIG. 2 is a partial sectional side view of the firearm shown in FIG. 1 with the firearm's action in battery.

FIGS. 2 and 2A shows an example breech cover interlock 34 for coordinating motion of the breech cover assembly 28 relatively to the breech 22 with the position of the fore end 26. In this example the interlock comprises a latch 36 mounted on the breech cover assembly 28 and movable therewith relatively to the breech 22. Interlock 34 further comprises an action bar 38 having a first end 40 which is attached to the fore end 26. A second end 42 of the action bar is oppositely disposed from the first end and comprises a catch 44. Action bar 38 defines a longitudinal axis 46 between its ends 40 and 42. The action bar 38 is movably mounted on the firearm and moves along a longitudinal axis 46 defined between its first and second ends 40 and 42. Latch 36 is advantageously pivotably mounted on the buttstock 30 via a pivot pin 48 to permit breakdown of the shotgun 10 as described below. A spring 50 acts between the buttstock 30 and the latch 36 for biasing the latch into engagement with the catch 44.

As shown in FIG. 2A, the latch 36 of the example embodiment comprises a first hook 52 and the action bar 38 comprises a second hook 54 positioned proximate to its second end 42. The first and second hooks 52 and 54 are engageable with one another. Engagement between the hooks is advantageously effected by contact between a first engagement surface 56 on the first hook 52 and a second engagement surface 58 on the second hook 54. To provide positive mechanical engagement between the hooks 52 and 54 the engagement surfaces 56 and 58 are oriented angularly with respect to the longitudinal axis 46 of the action bar 38. In the example embodiment the first engagement surface 56 has a first orientation angle 60 and the second engagement surface has a second orientation angle 62. The first and second orientation angles 60 and 62 are advantageously complementary to one another to permit reliable engagement and disengagement of the latch 36 and the catch 44. Practical orientation angles 60 and 62 may range from about 45° to about 60° although other values of the orientation angles are of course feasible. Action bar 38 may further comprise a ramp surface 64 positioned proximate to the catch 44. Ramp surface 64 engages the latch 36 upon relative motion between the action bar 38 and the latch, and the spring 50 maintains the latch in contact with the action bar during cycling of the shotgun's action, as shown by a comparison of FIGS. 2 and 3. In FIG. 2 the action 14 is in battery, in FIG. 3 the action is out of battery as indicated by the positions of the fore end 26 in each Figure. In FIG. 2 (in battery) the hooks 52 and 54 are engaged and any motion of cover 32 is prevented; in FIG. 3 (out of battery) the hooks are not engaged and the spring 50 maintains the hook 52 in contact with the action bar 38 as shown in FIG. 3A so that when the action is returned to battery (FIG. 2) during cycling of the action the hooks 52 and 54 reliably engage one another.

In operation, as shown starting with FIG. 2, the breech cover interlock 34 maintains the breech cover assembly 28 in the first position, with cover 32 overlying the breech 22 of barrel 18 when the fore end 26 is in its first position, fully forward toward the muzzle end 20 of barrel 18. With the fore end 26 fully forward, action 14 is locked in battery and the shotgun 10 is ready to fire if a live round is chambered within the barrel 18. Motion of the breech cover assembly 28 toward its second position (cover 32 not overlying breech 22) independent of the fore end 26 is prevented by engagement between latch 36 mounted on the buttstock 30 and the catch 44 of the action bar 38 (see also FIG. 2A), whose first end 40 is attached to the fore end 26 and therefore only moves when the fore end moves.

Figure 3:
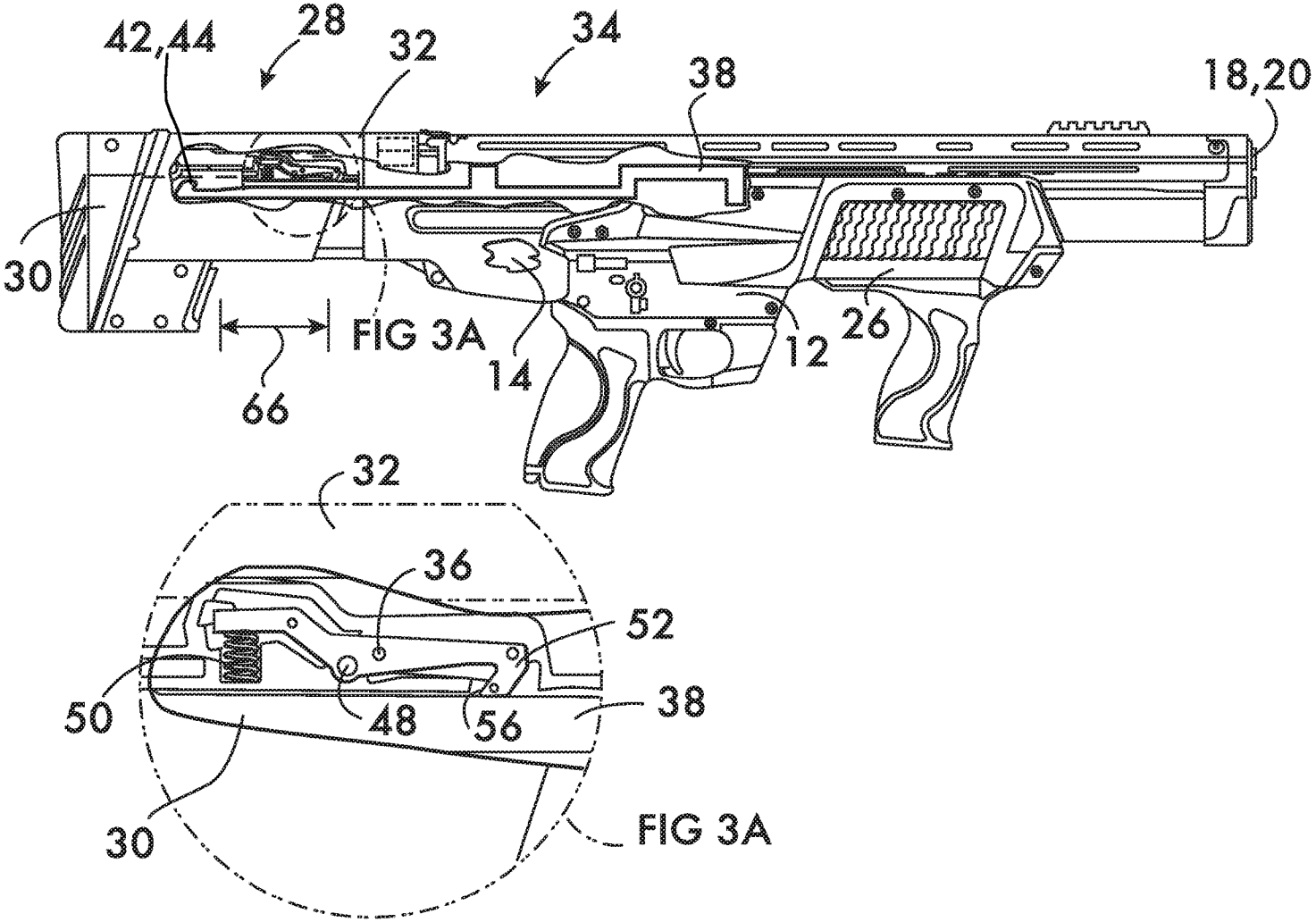
FIG. 3 is a partial sectional side view of the firearm shown in FIG. 1 with the firearm's action out of battery.

If access to the breech 22 is desired, for example, to clear a malfunction, then, as shown in FIGS. 3 and 3A, the action 14 is unlocked from battery by moving the fore end 26 away from the muzzle end 20 of barrel 18. Action bar 38, being attached to the fore end 26, moves with it, thereby disengaging catch 44 from the latch 36. As shown in detail in FIG. 3A, the latch 36 is maintained in contact with the action bar 38 by the biasing action of spring 50 and rides up the ramp surface 64 of the action bar (see FIG. 2), pivoting about pin 48. Motion of the action bar 38 disengaging the catch 44 from the latch 36 establishes a separation distance 66 between the engaging portions of the latch and the catch. In this example embodiment the separation distance 66 is between the respective engagement surfaces 56 and 58 of the first and second hooks 52 and 54.

Figure 4:
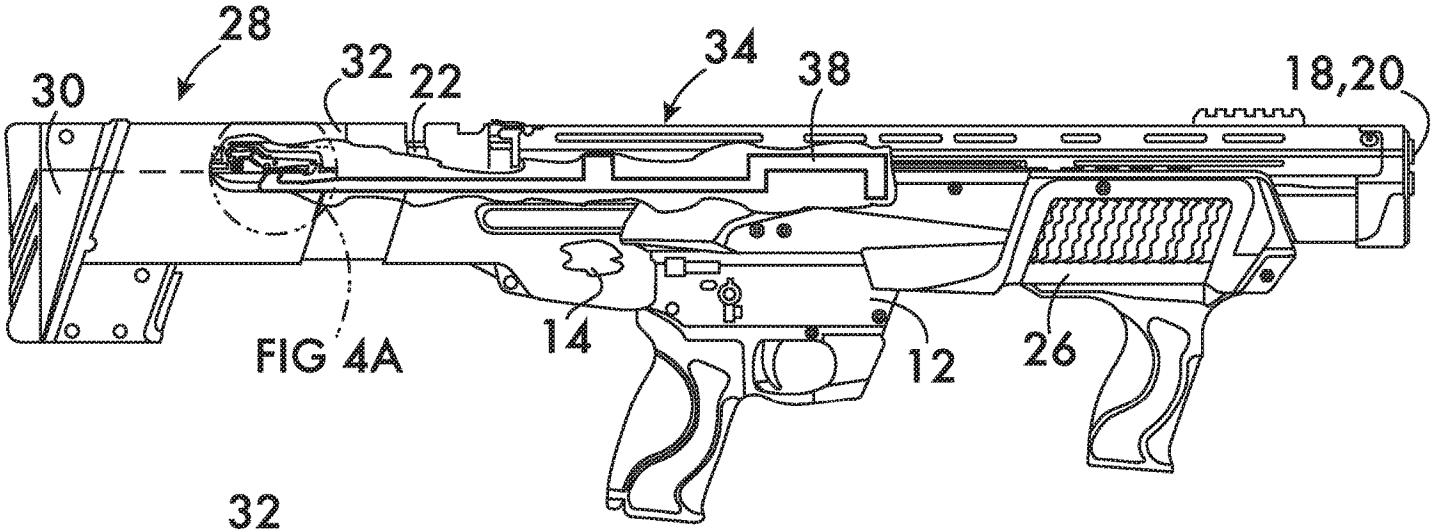
FIG. 4 is a partial sectional side view of the firearm shown in FIG. 1 having a breech cover in an open position.
Figure 4:
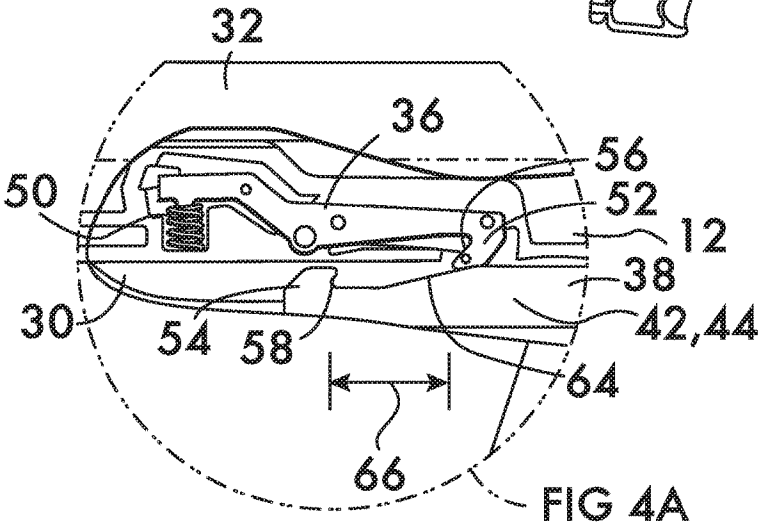

As shown in FIG. 4, with action 14 no longer in battery and with a separation distance between the latch 36 and the catch 44, the breech cover assembly 28 may be moved into its second position wherein the cover 32 is not overlying the breech 22. As shown in FIG. 4A, the separation distance 66 is reduced by motion of the breech cover assembly relative to the receiver 12. In a practical embodiment, the butt stock 30 comprising the breech cover assembly may be attached to the receiver 12 with a separate locking mechanism (not shown) from the breech cover interlock 34.

Figure 5:
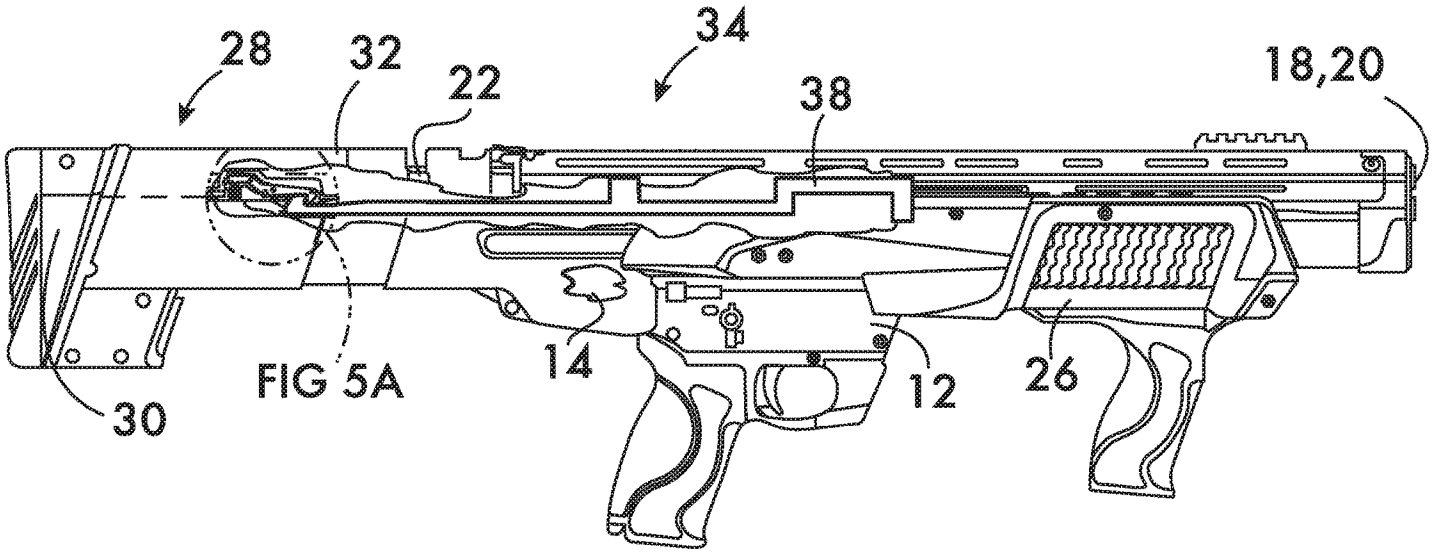
FIG. 5 is a partial sectional side view of the firearm shown in FIG. 1 illustrating closing of a breech cover.
Figure 5:
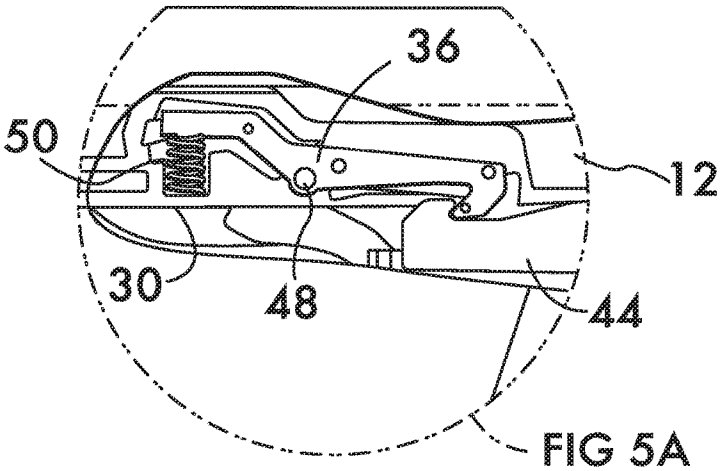

Breech cover assembly 28 may be returned to its first position overlying the breech 22 in two ways. The buttstock 30 may be pushed back into overlying relation with the breech 22 independently from motion of the fore end 26, or, as shown in FIGS. 5 and 5A, the fore end 26 can be pushed toward the muzzle end 20 of barrel 18 (compare positions of fore end 26 in FIGS. 4 and 5). Action bar 38 moves with the fore end 26 and the catch 44 on the action bar thereby engages the latch 36 on the buttstock 30 and draws the buttstock back into the first position with the cover 32 overlying the breech 22 (see FIG. 2). In either case, the buttstock 30 may again engage the aforementioned separate locking mechanism attaching it to receiver 12. The breech 22 is thus covered as the action 14 is driven into battery to chamber a live round as the fore end 26 moves toward the muzzle end 20 of the barrel 18 as shown in FIGS. 1 and 2.

Figure 6:
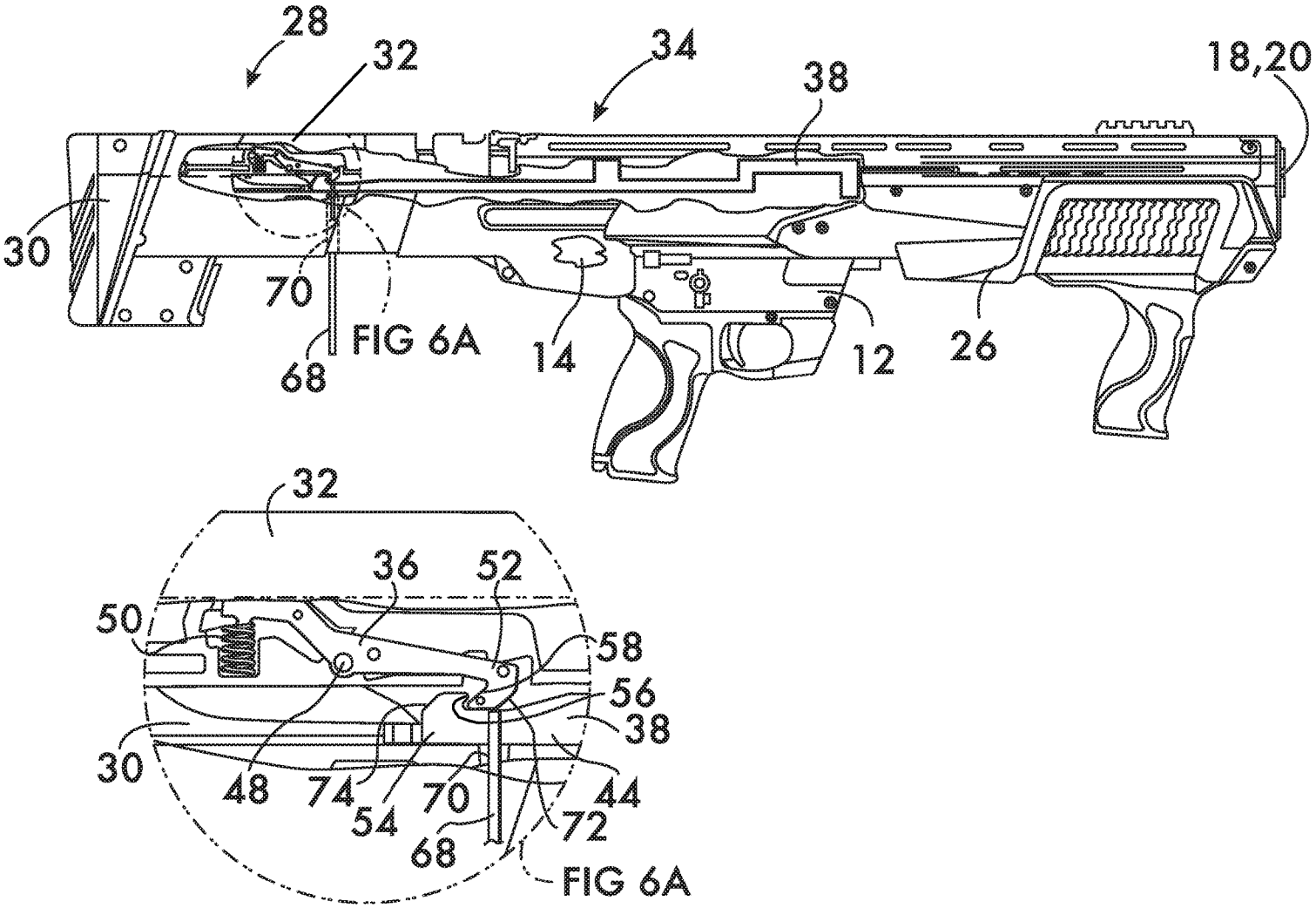
FIG. 6 is a partial sectional side view of the firearm shown in FIG. 1 illustrating manipulation of a breech cover for take down of the firearm.
Figure 6B:
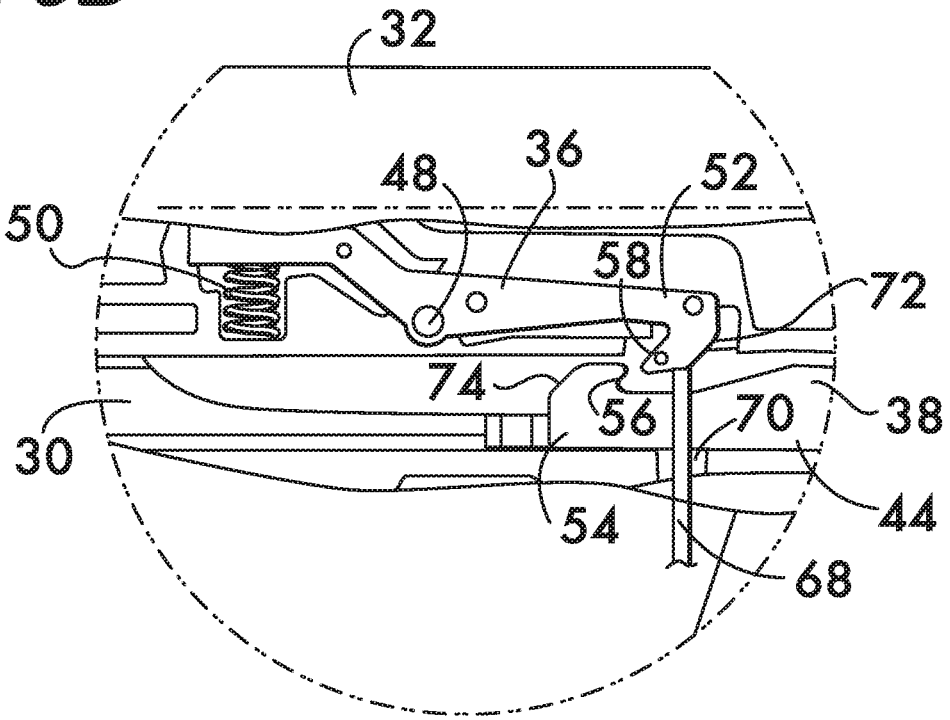
Figure 6C:
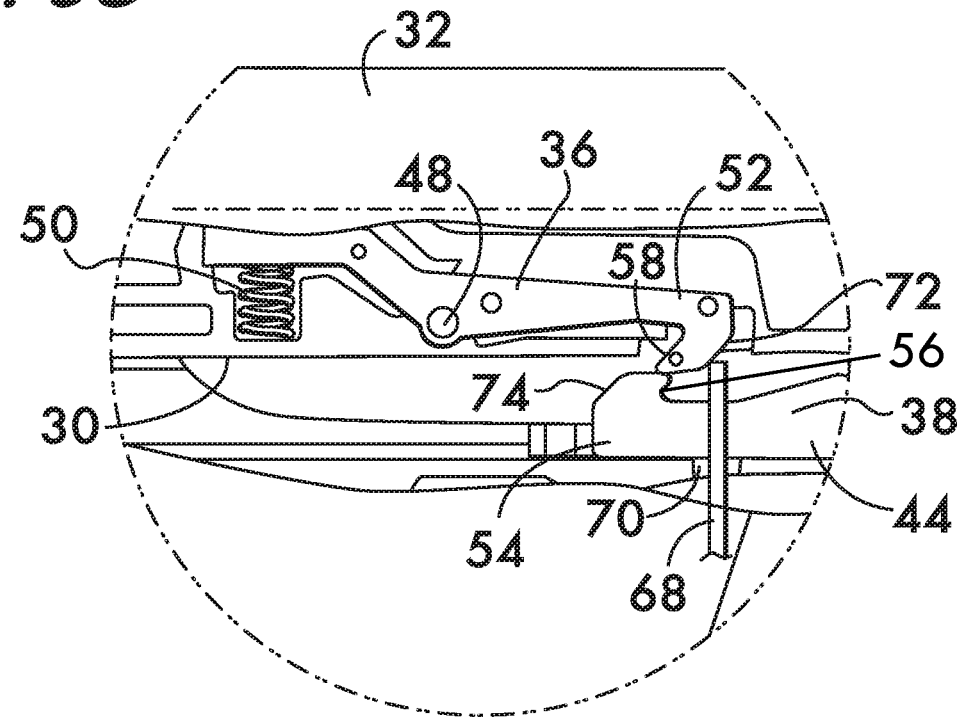

FIGS. 6, 6A, 6B and 6C illustrate steps necessary to take down the shotgun 10 having an interlock 34 according to the invention. For take down it is necessary to disengage the latch 36 from the catch 44. Disengagement is effected using a disassembly tool 68. As shown in FIGS. 6 and 6A, the tool 68 is inserted through an opening 70 in the buttstock 30. Opening 70 is positioned so that the tool 68 engages the latch 36. As shown in FIG. 6B, upon engagement between the tool 68 and the latch 36, force applied to the tool pivots the latch against the force of its biasing spring 50, separating the latch from the catch 44. When the latch 36 and catch 44 respectively comprise first and second hooks 52 and 54 as in this example, it is advantageous to provide some separation between the first and second engagement surfaces 56 and 58 to permit ready separation of the latch from the catch when desired. The spring 50 however otherwise reliably biases the latch 36 into engagement with the catch 44 to ensure proper contact between the engagement surfaces 56 and 58 during operation of the shotgun 10 as described above. As shown in a comparison of FIGS. 6B and 6C, with the latch 36 held out of alignment with the catch 44 (6B) the breech cover assembly 28 may be moved away and separated from the receiver 12 provided that the aforementioned separate locking mechanism which otherwise holds the assembly 28 to the receiver 12 is also actuated. Provision is also made for ease of reattachment of the breech cover assembly 28 to the receiver 12 through the use of first and second lead-in surfaces 72 and 74 positioned respectively on the first and second hooks 52 and 54. Each lead-in surface is positioned on its respective hook on an opposite side to the hook's engagement surface and each is angularly oriented with respect to the longitudinal axis 46 such that when the breech cover assembly 28 is again engaged with the receiver 12 the interaction between the lead-in surfaces 72 and 74 will cause the latch 36 to pivot about pin 48 and clear the catch 44. Once the breech cover assembly is positioned so that the first and second hooks 52 and 54 are no longer in contact the biasing spring 50 pivots the latch 36 so that the engagement surfaces 56 and 58 of the hooks are again in facing relation as shown in FIG. 6A.

It is expected that the use of a breech cover interlock according to the examples disclosed herein will improve the operation of breech loading firearms.

What is claimed is:

1. An interlock for coordinating motion of a breech cover assembly relatively to a breech of a firearm with a position of a fore end of said firearm, said breech cover assembly being movable between a first position overlying said breech and a second position not overlying said breech, said fore end being movable between a first position placing said firearm in battery and a second position placing said firearm out of battery, said interlock comprising:

a latch mountable on said breech cover assembly and movable therewith relatively to said breech;

an action bar having first and second ends oppositely disposed and defining a longitudinal axis therebetween, said action bar being movably mountable on said firearm, said first end being attachable to said fore end and said second end comprising a catch; wherein said catch is engageable with said latch when said fore end and said breech cover assembly are each in said first positions respectively, engagement between said catch and said latch preventing motion of said breech cover assembly into said second position while said firearm is in battery;

motion of said fore end into said second position disengaging said catch and said latch from one another thereby permitting motion of said breech cover assembly into said second position not overlying said breech when said firearm is out of battery.

2. The interlock according to claim 1, wherein said latch is pivotably mountable on said breech cover assembly.

3. The interlock according to claim 2, further comprising a spring biasing said latch into engagement with said catch.

4. The interlock according to claim 1, wherein:

said latch comprises a first hook;

said action bar comprises a second hook positioned proximate to said second end thereof, said first hook being engageable with said second hook.

5. The interlock according to claim 4, wherein:

said first hook comprises a first engagement surface oriented angularly with respect to said longitudinal axis;

said second hook comprises a second engagement surface oriented angularly with respect to said longitudinal axis, said first engagement surface contacting said second engagement surface when said hook engages said catch.

6. The interlock according to claim 5, wherein said first engagement surface has a first orientation angle and said second engagement surface has a second orientation angle, said first and second orientation angles being complementary to one another.

7. The interlock according to claim 2, wherein said action bar further comprises a ramp surface positioned proximate to said catch, said ramp surface engaging said latch upon relative motion between said action bar and said latch.

8. A firearm, said firearm comprising:

a receiver;

a barrel mounted on said receiver, said barrel having a breech;

an action positioned within said receiver;

a fore end mounted on said receiver and movable between a first position placing said action in battery and a second position placing said action out of battery;

a breech cover assembly mounted on said receiver, said breech cover assembly being movable between a first position overlying said breech and a second position not overlying said breech;

an interlock for coordinating motion of said breech cover assembly relatively to said breech with a position of said fore end, said interlock comprising:

a latch mounted on said breech cover assembly and movable therewith relatively to said breech;

an action bar having first and second ends oppositely disposed and defining a longitudinal axis therebetween, said action bar being movably mounted on said firearm, said first end being attached to said fore end and said second end comprising a catch; wherein said catch is engageable with said latch when said fore end and said breech cover assembly are each in said first positions respectively, engagement between said catch and said latch preventing motion of said breech cover assembly into said second position while said firearm is in battery;

motion of said fore end into said second position disengaging said catch and said latch from one another thereby permitting motion of said breech cover assembly into said second position not overlying said breech when said firearm is out of battery.

9. The firearm according to claim 8, wherein said latch is pivotably mounted on said breech cover assembly.

10. The firearm according to claim 9, further comprising a spring biasing said latch into engagement with said catch.

11. The firearm according to claim 8, wherein:

said latch comprises a first hook;

said action bar comprises a second hook positioned proximate to said second end thereof, said first hook being engageable with said second hook.

12. The firearm according to claim 11, wherein:

said first hook comprises a first engagement surface oriented angularly with respect to said longitudinal axis;

said second hook comprises a second engagement surface oriented angularly with respect to said longitudinal axis, said first engagement surface contacting said second engagement surface when said hook engages said catch.

13. The firearm according to claim 12, wherein said first engagement surface has a first orientation angle and said second engagement surface has a second orientation angle, said first and second orientation angles being complementary to one another.

14. The firearm according to claim 9, wherein said action bar further comprises a ramp surface positioned proximate to said catch, said ramp surface engaging said latch upon relative motion between said action bar and said latch.

15. The firearm according to claim 8, wherein said breech cover assembly comprises:

a buttstock mounted on said receiver, said buttstock being movable toward and away from said breech, said latch being mounted on said buttstock;

a cover mounted on said buttstock.

16. The firearm according to claim 15, wherein said latch is pivotably mounted on said buttstock.

17. The firearm according to claim 16, further comprising a spring acting between said buttstock and said latch for biasing said latch into engagement with said catch.

18. The firearm according to claim 8, wherein said firearm comprises a shotgun.

19. The firearm according to claim 18, wherein said shotgun has a bullpup configuration.

* * * * *